United States Patent [19]

Perry

[11] 3,995,663

[45] Dec. 7, 1976

[54] HIGH SOLIDS BRINE DISTRIBUTOR

[75] Inventor: Clifford R. Perry, Kent, Wash.

[73] Assignee: The Boeing Company, Seattle, Wash.

[22] Filed: Oct. 21, 1974

[21] Appl. No.: 516,780

[52] U.S. Cl. ..... 138/38; 138/96 R; 138/108; 138/109; 165/118

[51] Int. Cl.[2] ..... F15D 1/02; B65D 59/00

[58] Field of Search ..... 138/38, 39, 40, 108, 138/109, 96 R, 177, 178; 165/174, 109 T, 179, 118, 134; 159/13 A, 28 D, 27 D; 122/44 A, 367 C

[56] References Cited

UNITED STATES PATENTS

| | | | |
|---|---|---|---|
| 1,184,936 | 5/1916 | Falkenwalde | 138/38 |
| 1,694,370 | 12/1928 | Burdick | 165/118 |
| 2,143,477 | 1/1939 | Dillon et al. | 138/39 |
| 2,225,615 | 12/1940 | Bay | 163/134 |
| 2,424,441 | 7/1947 | Edmonds | 138/38 |
| 2,602,647 | 7/1952 | Miller | 165/174 |
| 2,750,628 | 6/1956 | Remier | 138/38 |

*Primary Examiner*—Harry N. Haroian
*Attorney, Agent, or Firm*—Bacon & Thomas

[57] ABSTRACT

A liquid distributing device for use in the upper end of an upright tube in a vertical, tubular heat exchanger, which device comprises a ferrule having a head adapted to seat upon the upright tube, a cylindrical sleeve adapted to fit snugly within said tube, a bore in said head, and means to distribute liquid from said bore onto the inside surface of said cylindrical sleeve and then onto the inside surface of the upright tube as a falling film, whereby errosion of the tube by impingement of liquid thereon is minimized. Means are also provided to prevent building of scale within the ferrule.

7 Claims, 2 Drawing Figures

HIGH SOLIDS BRINE DISTRIBUTOR

BACKGROUND OF THE INVENTION

This invention relates to liquid distributing devices for use in the upper end of tubes of a vertical shell-and-tube heat exchanger and, in particular, to liquid distributing devices of the type described which are intended to provide liquid in the form of a falling film on the inside surfaces of the vertical tubes of the heat exchanger. The use of tube and shell heat exchangers for falling film evaporation of aqueous solutions is well known in the art. Reference is made to the United States Patent to Bryan et al, U.S. Pat. No. 3,437,124 for an illustration of heat exchangers of this type.

In the operation of vertical shell-and-tube heat exchangers in which liquid is to be provided as a falling film on the interior of the tubes there has always been a problem of properly distributing the liquid at the top of the tube. Many devices have been proposed for such purpose. Illustrative of such devices are those disclosed in the patents to Edmonds, U.S. Pat. Nos. 2,424,441, 2,949,935 and 3,016,067, to Eckstrom et al, U.S. Pat. No. 2,753,932 and in British Patent No. 261,731 of Mar. 10, 1927. However, in the prior art devices there are continued problems with tube corrosion and wear, scale formation and the like, particularly when high solid brines are being handled.

SUMMARY OF THE INVENTION

The present invention provides a liquid distributing device for use in the upper end of an upright tube of a vertical tubular heat exchanger which is so designed as to minimize or eliminate the problems described above.

Briefly, the liquid distribution device of the invention comprises a ferrule having a head adapted to seat upon the upright tube, a cylindrical sleeve depending from the head and adapted to fit snugly within the top portion of the tube, a bore in the head for entry of liquid from a header or manifold into the ferrule, and means to distribute liquid from the bore onto the inside surface of the cylindrical sleeve for distribution thereby onto the inside surface of the upright tube as a falling film. The means to distribute liquid from the bore to the inner surfaces of the sleeve may be a cone or the like suitably mounted within the ferrule, with its apex in axial alignment with the bore and with its lower edge above the lower edge of the sleeve, whereby liquid entering the bore is distributed by the member onto the inner wall surface of the sleeve, which in turn delivers the liquid as a falling film on the inside wall surface of the vertical tube. By this means the liquid is caused to impinge on the sleeve rather than on the tube walls. The ferrules may, of course, be readily replaced when worn or damaged and the life of the heat exchanger tubes is thereby preserved.

Further, the ferrule of the invention preferably is provided with inclined inner walls which obviate dead spaces or spaces in which liquid can splash and cause scale buildup. In a preferred embodiment, an inside portion of the ferrule is spaced from a conical inner distributing member and has a corresponding downward and outward inclined wall. Further, the inner wall of the lower end of the cylindrical sleeve preferably tapers outwardly to facilitate film transfer to the inner wall of the surface of the upright tube.

The head of the ferrule is preferably of relatively flat disk shape to permit the passage of wipers, brushes or the like which may be used in the header of the tube bank. However, the invention is not limited to this particular head configuration.

An object of the invention, therefore, is to provide a liquid distributing device for vertical upright tubes of a tube-and-shell heat exchanger which will distribute fluids, in particular, high solids brines and the like, in the form of a falling film to the vertical tube without the usual corrosion and scaling difficulties.

BRIEF DESCRIPTION OF THE DRAWINGS

Reference is made to the accompanying drawings in which.

DESCRIPTION OF THE PREFERRED EMBODIMENT

Figure 1:
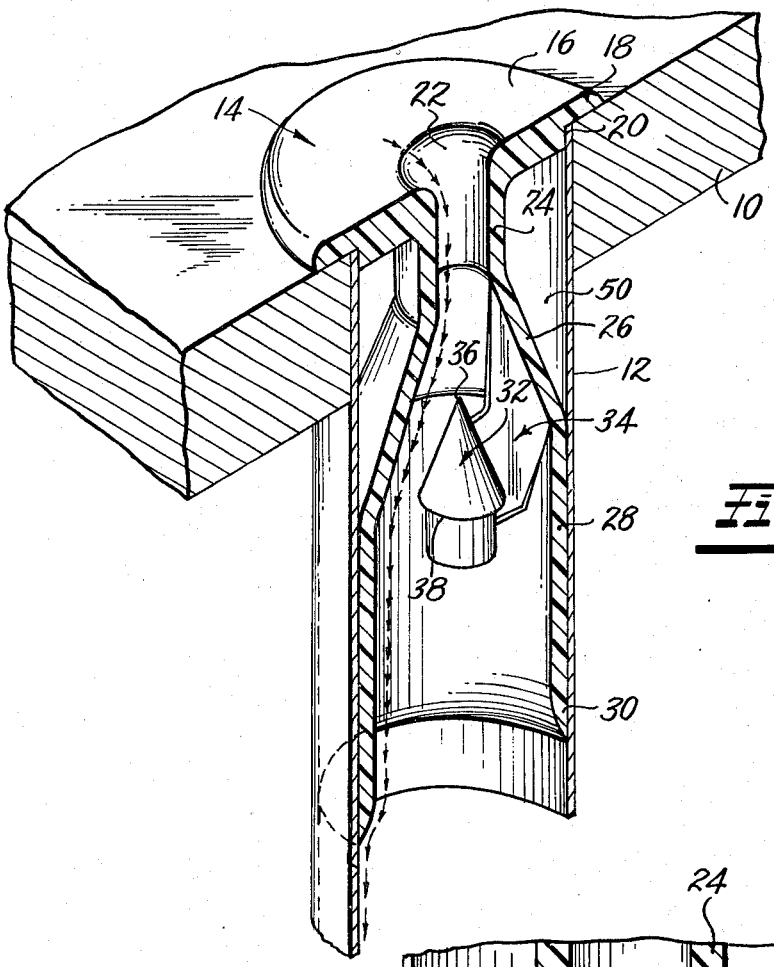
FIG. 1 is an isometric projection showing a cross-section through a fragmentary portion of the header of a tube-in-shell exchanger with one of the liquid distributing devices of the invention in place therein.

Referring now to FIG. 1 of the drawings, there is shown a fragmentary portion 10 of the upper tube sheet of a conventional tube-in-shell heat exchanger. The structure of such heat exchangers and the operation thereof as falling film evaporators is well known in the art and needs no further description herein. One of the vertical upright tubes 12 of such heat exchanger is shown in place in the tube sheet 10. It will be understood that the bottom of the tube 12 is mounted in a lower tube sheet, not shown.

The liquid distributing device of the invention comprises ferrule 14, which may be molded or otherwise fabricated from any material suitable to withstand the environment in high solids evaporators. It may be fabricated of metal or molded from suitable plastic. The ferrule comprises a head 16 which is disk-like in configuration and is provided with an annular flange 18 and shoulder 20, so as to seat snugly within the top of the tube 12. The head 16 is provided with an axial bore 22, which is of such size as to control the flow rate down the tube. The size of the bore 22 can be appropriately selected for the particular operation to which the heat exchanger is desired. It will be understood, of course, that the ferrule 14 can be constructed in a range of diameters to fit condensor tubes of various diameters so that the device is adaptable to all high solids evaporators and similar heat exchangers.

A cylindrical connecting wall 24 is formed so as to provide an extension of the bore 22. This facilitates the formation of a solid column of liquid entering into the hollow body of the ferrule from the header. This wall 24 can be of any selected length or can be substantially eliminated depending upon the particular system in which the ferrule is installed. A radially diverging, downwardly and outwardly extending connecting wall 26 extends from the wall portion 24 to an upper portion of cylindrical sleeve portion 28, which is dimensioned to fit snugly within the tube wall 12. The lower edge of the wall 28 is preferably tapered outwardly, as shown at 30 in order to provide smooth distribution of liquid flowing down the inside surface of the wall 28 to the inside surface of the tube 12. The course of the liquid through the ferrule is shown by the arrows.

A liquid distributing member 32 is mounted by means of web 34, within the hollow portion of the ferrule 14. The distributing member 32 may be of conical shape, as shown, but is not necessarily limited to this exact configuration provided it has an upwardly directed apex (smaller transverse dimension) in axial alignment with the bore 22 and a lower distributing edge (larger transverse dimension) which will serve to direct the flow of liquid against the inner surface of the sleeve 28. The conical member 32, as shown, has such an apex 36 and lower edge 38, the diameter of lower edge 38 being larger than the diameter of bore 24 in the example illustrated.

Figure 2:
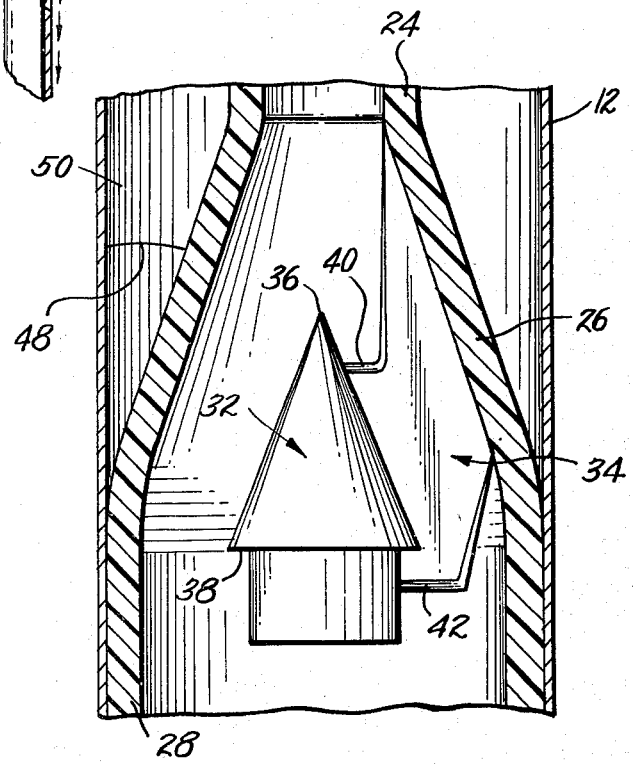
FIG. 2 is an enlarged sectional view of a portion of the ferrule shown in FIG. 1.

The conical distributing member 32, as shown in FIG. 2, may be contained substantially within the inclined wall 26 or partially within and partially below this wall. The essential feature is that it distribute liquid evenly upon the inner surface of sleeve 28 at an annular area well above the bottom of the sleeve so that the liquid can descend the inner wall of the sleeve as a falling film which is then transferred to the inner tube wall. As shown in FIG. 2, the radial distance between the periphery of the tapered portion of member 32 and the inner wall of the ferrule becomes progressively smaller towards the lower end of the tapered portion of member 32, which has been found to provide an added benefit in forming an evenly distributed film of falling liquid within sleeve 28. The flow area between the member 32 and the sleeve 28, of course, is not less than the flow area of the bore 22 to enable free flow through the ferrule of liquid passing through the bore. Web member 34 may be streamlined as at 40 and 42 to facilitate the smooth flow of liquid. Additional web supporting members may be provided, particularly when the ferrule is of large size. For example, in the larger sizes, three such supporting members may be arranged in the form of a spider.

In operation, the high solids liquid or brine or other solution to be evaporated is provided in a flood box or header above the tube sheet 10 in the manner known in the art to a depth required to provide the desired flow rate for the evaporator tubes. The liquid enters the bore 22 in the top of the distributing ferrule 14 and forms a solid column of liquid as it travels in a downward vertical direction between the walls 24. This column of liquid then impinges on the apex 36 of the distributing cone 32, which separates the liquid into a film with decreasing thickness as it expands outward. The cone angle is selected to appropriately suit film thickness, tube size, flow rate and velocity requirements of the particular operation. The film then impinges on the inner surface of the cylindrical sleeve 28. This sleeve provides an errosion shield for the condensor tube and also allows complete filming of the tube before the liquid enters the heat transfer area. This feature prevents unwetted heat transfer surfaces on the tube 12, which are susceptible to scaling. The cone angle, velocities, and flow rates can be selected to provide a low impingement angle 48 (FIG. 2) in order to minimize errosion of the sleeve from the high solids liquid.

The inclined wall 26 is designed to prevent splashing of fine solids into the upper cavity volume 50. It will be understood that the ferrule could be made as a solid piece so as to avoid cavity 50 at the expense of using additional material. Without the provision of shielding or filling this area, fine solids may tend to build up in the cavity and possibly plug the distributor.

It can be seen that any particle of such size which can enter the bore 22 will pass entirely through the brine distributor. Wipers, scrapers, or screens can be used to limit the particle size in a recirculating high solids brine system. It will be understood, of course, that it is possible to replace any ferrule which may inadvertently become clogged, by simply lifting out the ferrule and inserting a clean ferrule into the exposed tube.

I claim:

1. A liquid distributing and erosion shield device for use in the upper end of an upright tube in a vertical tubular heat exchanger, said device comprising: a ferrule having a head portion dimensioned to seat centrally upon and close the upper end of said upright tube when installed, and a depending cylindrical sleeve portion dimensioned to fit snugly within said upright tube and having an interior side wall; means defining a central axial bore including an inner bore wall extending through and below said head portion for enabling formation and passage into said ferrule of a column of fluid, said bore being of substantially smaller diameter than said sleeve; an annular wall means within said ferrule including a radially divergent portion smoothly connecting said inner bore and an upper portion of the interior side wall of said sleeve; and an axially extending tapered fluid distributing member centrally mounted in said ferrule below said bore, the smaller end of said fluid distributing member being disposed towards and in axial alignment with said bore and the larger end of said member being disposed above the lower edge of said sleeve portion; whereby, when the ferrule is installed, the falling liquid column is uniformly distributed in a radially outward and downward direction by said tapered member onto the interior side wall surface of the sleeve portion of the ferrule which in turn delivers the fluid as a falling film onto the inside wall surface of said vertical tube.

2. A liquid distributing device for use in the upper end of an upright tube in a vertical tubular heat exchanger, said device comprising: a hollow ferrule having a disc-like head portion adapted to seat concentrically upon and close the upper end of said upright tube when installed, said head portion having a central, axially extending bore having a substantially smaller diameter than said tube; a cylindrical wall portion depending axially downwardly from said head portion and forming an extension of said bore, and a radially outwardly diverging annular wall portion depending from said cylindrical wall portion and terminating in a cylindrical sleeve portion of said ferrule dimensioned to fit snugly within the upper portion of said upright tube; and an axially extending fluid distributing conical member centrally mounted at least in part within the area encompassed by said diverging wall portion and below said bore, said conical member having its apex upwardly directed in alignment with said bore; the lower edge of the conical member being disposed above the lower edge of the sleeve portion of the ferrule; the lower edge of the sleeve portion of said ferrule being tapered outwardly; whereby, when the ferrule is installed, liquid entering said bore and cylindrical wall portion of said ferrule and falling therefrom as a fluid column is distributed by said conical member radially outwardly and downwardly onto the interior side wall surface of said cylindrical sleeve which in turn delivers said liquid as a falling film onto the inside wall surface of the vertical tube, the tapered lower edge of said sleeve portion facilitating the smooth transfer of film to the inner wall surface of the tube.

3. The device recited in claim 2, wherein said bore includes an inner side wall and said radially diverging wall portion forms a smooth transition surface between the inner side wall of said bore and the interior side wall of the sleeve portion of the ferrule.

4. A liquid distributing device for use in the upper end of an upright tube in a vertical tubular heat exchanger, comprising: a ferrule element having a head portion dimensioned to seat concentrically upon and close the upper end of said tube when installed, a hollow sleeve portion connected to and depending from said head portion, said sleeve portion being dimensioned to fit snugly within said tube, said head portion including means defining an axial bore extending therethrough of smaller diameter than said sleeve portion, said bore and sleeve portions having inner wall surfaces, and a connecting inner wall portion smoothly connecting said inner wall surfaces of said bore and sleeve portions, said connecting inner wall portion including both an upper cylindrical and a lower radially diverging wall section; and an axially extending liquid distributing member centrally supported within said ferrule, said member being axially tapered, having its upper end of smaller transverse dimension aligned with and disposed towards said bore, and having its lower edge area of a larger transverse dimension terminating at a point above the lower edge of said sleeve portion of said ferrule, whereby, when the ferrule is installed, liquid entering said bore and falling as a liquid column is distributed by said member onto the inner wall surfaces of said sleeve which in turn delivers said liquid as a falling film onto the inside wall surface of said vertical tube.

5. The device recited in claim 4, wherein said film distributing member is generally conical in form and is disposed within said ferrule so that a portion of the tapered outer side wall of said liquid distributing member is located within the area encompassed by said radially diverging wall portion of said ferrule, to thereby form an annular liquid flow space between said liquid distributing member and said radially diverging wall portion of said ferrule.

6. The device recited in claim 5, wherein the radial distance between the surface of the conical portion of the distributing member and the adjacent inner wall surface of the sleeve decreases from the upper end of the conical portion of the distributing member to the lower end thereof.

7. The device recited in claim 6, wherein the maximum diameter of said fluid distributing member is larger than the smallest diameter of said bore, but wherein the transverse cross-sectional area of said annular liquid flow space is at least as large at the transverse cross-sectional area of said bore.

* * * * *